US006253642B1

(12) United States Patent
Junkers

(10) Patent No.: US 6,253,642 B1
(45) **Date of Patent: *Jul. 3, 2001**

(54) POWER TOOL

(76) Inventor: John K. Junkers, 7 Arrowhead La., Saddle River, NJ (US) 07540

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/158,610

(22) Filed: Sep. 22, 1998

(51) Int. Cl.[7] ..... B25B 17/00
(52) U.S. Cl. ..... 81/55; 81/56
(58) Field of Search ..... 81/56, 55, 57.36, 81/57.39

(56) References Cited

U.S. PATENT DOCUMENTS

| | | | | |
|---|---|---|---|---|
| 2,790,343 | * | 4/1957 | White | 81/55 |
| 3,247,741 | | 4/1966 | Batten . | |
| 3,815,211 | * | 6/1974 | Acord, IV | 81/56 |
| 3,868,872 | | 3/1975 | Wing . | |
| 4,179,955 | | 12/1979 | Akiyoshi . | |
| 4,836,063 | * | 6/1989 | Fushiya | 81/55 |
| 5,123,308 | * | 6/1992 | Yasutomi | 81/56 |
| 5,318,393 | | 6/1994 | Yamada . | |
| 5,490,439 | * | 2/1996 | Matsumura et al. | 81/56 |
| 5,582,079 | | 12/1996 | Matsumura . | |

FOREIGN PATENT DOCUMENTS

| | | | | |
|---|---|---|---|---|
| 2328444 | * | 1/1975 | (DE) | 81/55 |
| 3237325 | * | 4/1984 | (DE) | 81/56 |
| 7312435 | * | 3/1975 | (NL) | 81/55 |

* cited by examiner

*Primary Examiner*—Joseph H. Hall, III
*Assistant Examiner*—Daniel Shanley
(74) *Attorney, Agent, or Firm*—Michael J. Striker

(57) ABSTRACT

A power tool for tightening and loosening a bolt connected with a nut and a washer arranged so that the nut banks with one of its sides onto one of washer faces, the power tool comprising a housing, drive means accommodated in the housing, and at least two coaxial connecting means including a first connecting means provided for engaging and turning the nut and subjected to a turning force in one direction, and a second connecting means subjected to a turning force in an opposite direction, the coaxial connecting means being formed so that one of the coaxial connecting means is being turned while the other of the two coaxial connecting means stand still depending on a turning friction encountered as a result of one being connected with the washer while the other one is connected with the nut, or the result of one being connected with the bolt and the other one is connected with the nut, or as a result of one being connected with a reaction arm adapted to abut against an adjacent stationary object while the other one is connected with the nut.

7 Claims, 5 Drawing Sheets

POWER TOOL

BACKGROUND OF THE INVENTION

The present relates to power tools for tightening and loosening threaded connectors, such as bolts provided with nuts and washers.

It is known that most pneumatic, hydraulic or manually operated torque tools have a smaller operating radius than the nut placed on for tightening. It is also known that the industry is trying to build smaller equipment despite higher pressures and bigger loads.

U.S. Pat. No. 5,318,393 discloses a nut which is composed of two sleeves surrounding the bolt. Its diameter can not be reduced relative to the nut it replaces. A tensioning bolt disclosed in my U.S. patent application Ser. No. 091033,790 filed on Mar. 3, 1998 makes feasible to reduce the outside diameter of the nut below 1.5 times the bolt diameter. This allows the manufacturer to put the bolts closer together so as to obtain a better compression flow on the flange or casing. By placing the bolts closer together, more and thus smaller bolts can be applied to obtain the desired compression, especially since the preset, desired residual load can be obtained very accurately.

For tensioning of a bolt, a turning action force is applied by a power tool, and at the same time a reaction force must be applied which counteracts the turning action force. It is desirable to provide possibilities to apply the reaction force on various parts of the threaded fasteners, such as bolts provided with nuts and washers.

SUMMARY OF THE INVENTION

Accordingly, it is an object of present invention to provide a power tool which is a further improvement of the existing power tools for tightening or loosening bolts provided with washers and nuts.

In keeping with these objects and with others which will become apparent hereinafter, one feature of present invention resides, briefly stated, in a power tool for tightening and loosening a bolt having a nut and a washer arranged so that the nut banks with one of its sides onto one of washer faces, the power tool comprising A power tool for tightening and loosening a bolt connected with a nut and a washer arranged so that the nut banks with one of its sides onto one of washer faces, the power tool comprising a housing, drive means accommodated in the housing, and at least two coaxial connecting means including a first connecting means provided for engaging and turning the nut and subjected to a turning force in one direction, and a second connecting means subjected to a turning force in an opposite direction, the coaxial connecting means being formed so that one of the coaxial connecting means is being turned while the other of the two coaxial connecting means stand still depending on a turning friction encountered as a result of one being connected with the washer while the other one is connected with the nut, or the result of one being connected with the bolt and the other one is connected with the nut, or as a result of one being connected with a reaction arm adapted to abut against an adjacent stationary object while the other one is connected with the nut.

When the power tool is designed in accordance with the present invention, then during tightening or loosening a threaded connector an active turning force is applied to the nut of the bolt, while a reaction force can be applied by the tool directly to the bolt so that the action force, turns around it, or it can be indirectly applied to the bolt through the washer which is connected to the bolt so that the action force turns inside the applied reaction force or the reaction force can be applied as a result of a connection to a reaction arm that abuts against an adjacent stationary object.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
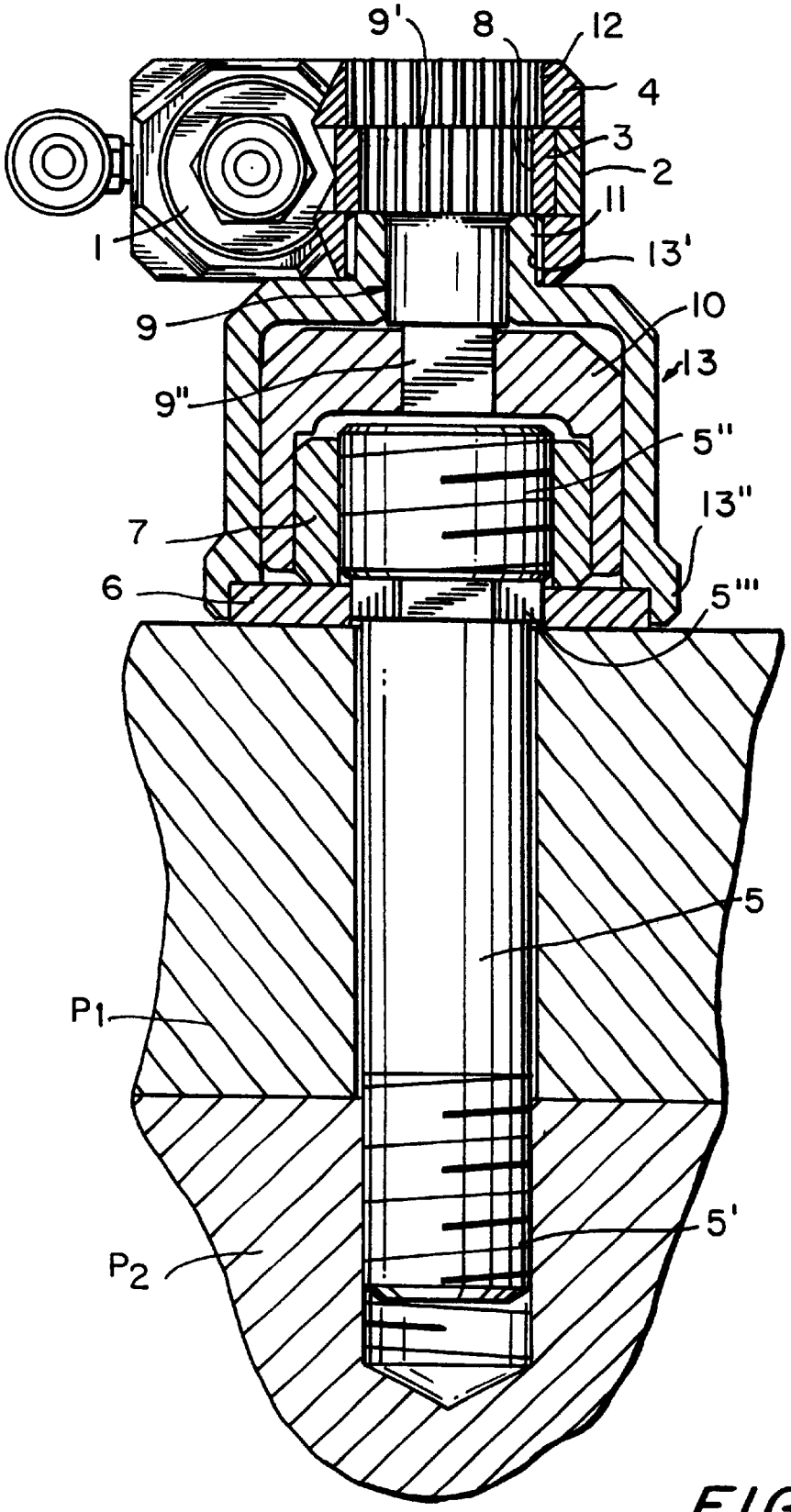
FIGS. 1 and 2 are views showing a lever-type power tool in accordance with the present invention, which is provided for tightening or loosening a bolt having a washer and a nut, with application of a reaction force to the washer in FIG. 1 and to the bolt in FIG. 2.

A power tool shown in FIG. 1 is a lever-type power tool. It has drive means formed for example as a well known hydraulic drive which during a displacement of a piston in a hydraulic cylinder turns a drive plate 2, which in turn turns a ratchet 3 through a pawl-ratchet mechanism. The tool further has a housing extending perpendicular to the axis of the drive unit 1 and to an axis of the bolt. The housing is identified with reference numeral 4 and accommodates the hydraulic drive 1 and the drive plate 2 with the ratchet 3.

The power tool is used for tightening or loosening a threaded connector which includes a bolt 5 extending through, for example, two parts P1 and P2. The bolt 5 has a main portion 5' extending through the parts P1 and P2, a threaded portion 5", and an intermediate portion 5'" which can have a polygonal outer surface. The threaded connector further has a polygonal washer which is identified with reference numeral 6. The polygonal washer has an inner polygonal opening which it is fitted on the polygonal portion 5'" of the bolt 5, and an outer polygonal surface. The threaded connector finally has a nut 7 which is formed as a conventional hexagonal nut having an inner threaded opening for screwing on an outer threaded surface of the portion 5" of the bolt 5, and also having an outer hexagonal surface.

The power tool further has first connecting means 8 for connecting the drive unit 1 with the nut 7. The first connecting means 8 can be formed by a plurality of splines provided on an inner surface of the ratchet 3 and coaxial with an axis of the bolt 5. First transmitting means is provided for transmitting a rotation of the ratchet 3 to the nut 7. The first transmitting means include a stepped shaft 9 which has a first portion 9' provided with a plurality of splines engaging with the splines of the first connecting means 8, and a second square portion 9" connected with a drive socket 10. The drive socket 10 has a square opening with which it is fitted on the square portion 9" of the shaft 9, and a tubular portion provided with an inner hexagonal opening with which the socket 10 can be fitted on the outer hexagonal surface of the nut 7.

The power tool further has second connecting means. The second connecting means include two selectively actuatable means. One of the selectively actuatable means is identified with reference numeral 11 and formed for example by a plurality of inner splines which are coaxial with the axis of the bolt. The inner splines 11 are located at one side of the housing as considered in an axial direction of the bolt. In particular, as can be seen from FIGS. 1 and 2, the inner splines 11 are located in the lower part of the housing 4. The second connecting means further includes another selectively actuatable means which is identified with reference numeral 12 and formed for example by a plurality of inner splines which are coaxial to the axis of the bolt and located at an opposite side of the housing as considered in direction of the axis of the bolt, or in the upper part of the housing. The first connecting means 8 and the second connecting means 11, 12 are coaxial with one another.

As can be seen from FIG. 1, a transmitting means formed as a reaction socket 13 non-rotatably connect the selectively actuatable means 11 to the washer 6. The transmitting means is formed as a reaction socket which has a portion 13' provided with outer splines engaging with the inner splines of the selectively actuatable means 11, and a portion 13" having a hexagonal inner surface fitted on the hexagonal outer surface of the washer 6.

Figure 2:
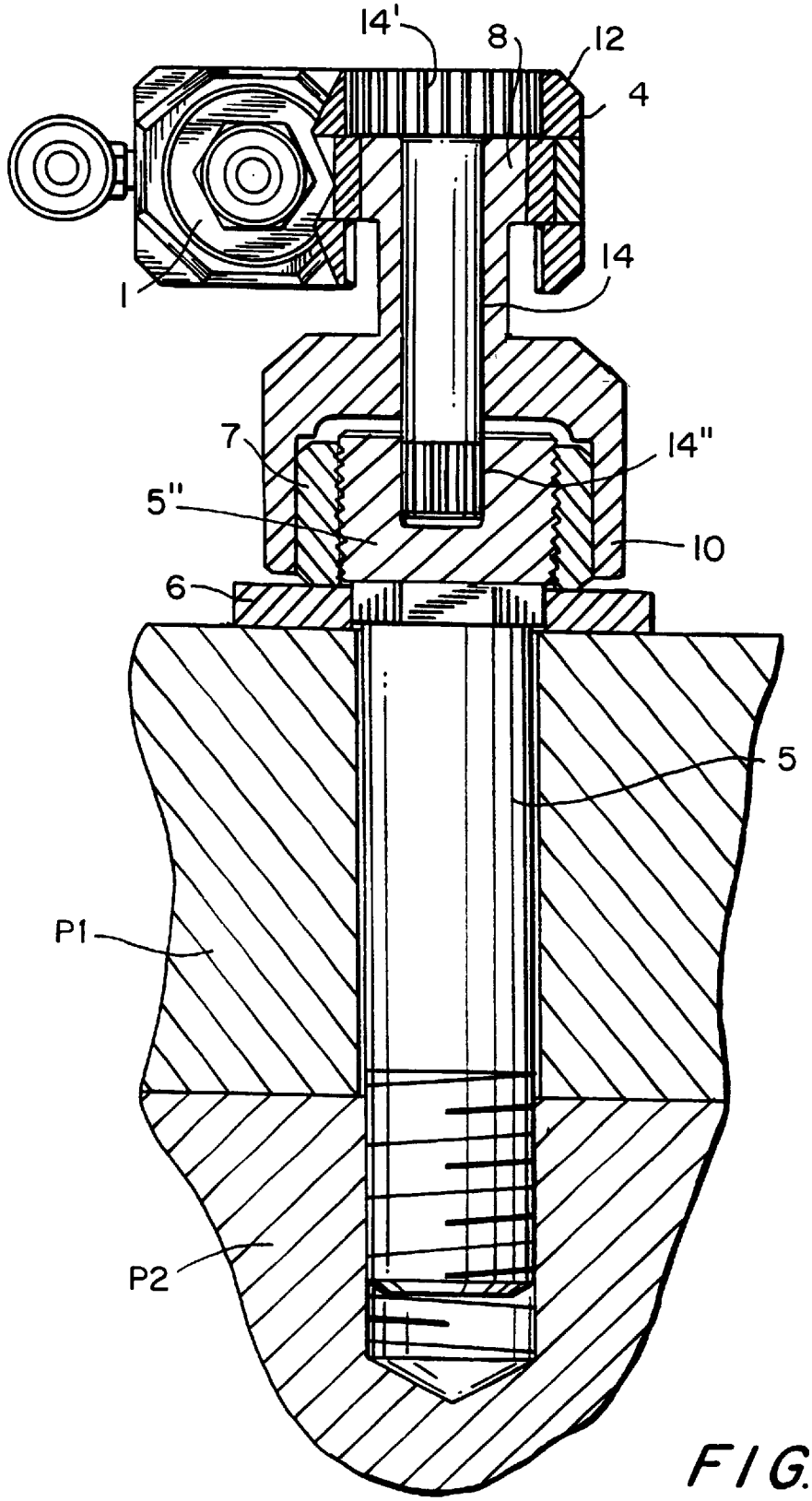

As can be seen from FIG. 2, another transmitting member 14 non-rotatably connects the selectively actuatable means 12 with the bolt 5. The transmitting member 14 is formed as a shaft having one portion 14' provided with outer splines engaging with the inner splines of the selectively actuatable means 12 , and a portion 14" provided with outer splines and engaging with inner splines formed in an end opening of the bolt 5.

The lever-type power tool in accordance with the present invention operates in the following manner:

In the lever-type tool, such as for example a hydraulic wrench, with the tool housing perpendicular to the axis of the drive unit and the bolt axis, the tool housing can not turn around the bolt without hitting obstacles on the side of the application. Therefore, the tool housing has to remain stationary at all times. When it is desirable to apply an active turning force to the nut 7 and to apply a reaction force to the washer 6, the embodiment shown in FIG. 1 is utilized. The drive unit 1 is activated and turns the drive plate 2, the ratchet 3 is turned by the drive plate 2 and through the first connecting means 8 it turns the shaft 9 so that the drive socket 10 is turned, and the nut 7 engaged by the drive socket is turned. The reaction socket 13 is non rotatably connected to one side of the housing, in particular to the selectively actuatable means 11 of the second connecting means on the one hand, and non rotatably connected to the washer 6 on the other hand. The washer 6, in turn, is non rotatably connected with the bolt 5 through the portion 5'". As a result, a reaction force is applied to the bolt, while the active force is applied to the nut, the nut is turned, and the bolt is tensioned or relaxed in the parts P1 and P2, torsion- and side-load free.

When it is necessary to apply a reaction force directly to the bolt 5, the embodiment of FIG. 2 is utilized. Here also, the nut 7 is turned by the drive socket 10 which is non-rotatably connected to the first connecting means 8 provided in the ratchet 3 which is turned in the drive plate 2 by the drive unit 1. However, in contrast to the embodiments shown in FIG. 2, the shaft 14 which is non-rotatably connected with the selectively actuatable means 12 of the second connecting means provided on the opposite side of the housing 4 is directly non-rotatably connected by its portion 14" with the bolt 5. Therefore, during the operation of the tool only the nut turns, but the bolt does not turn and instead is tensioned or relaxed in the parts P1 and P2, torsion and side-load free.

Figure 3:
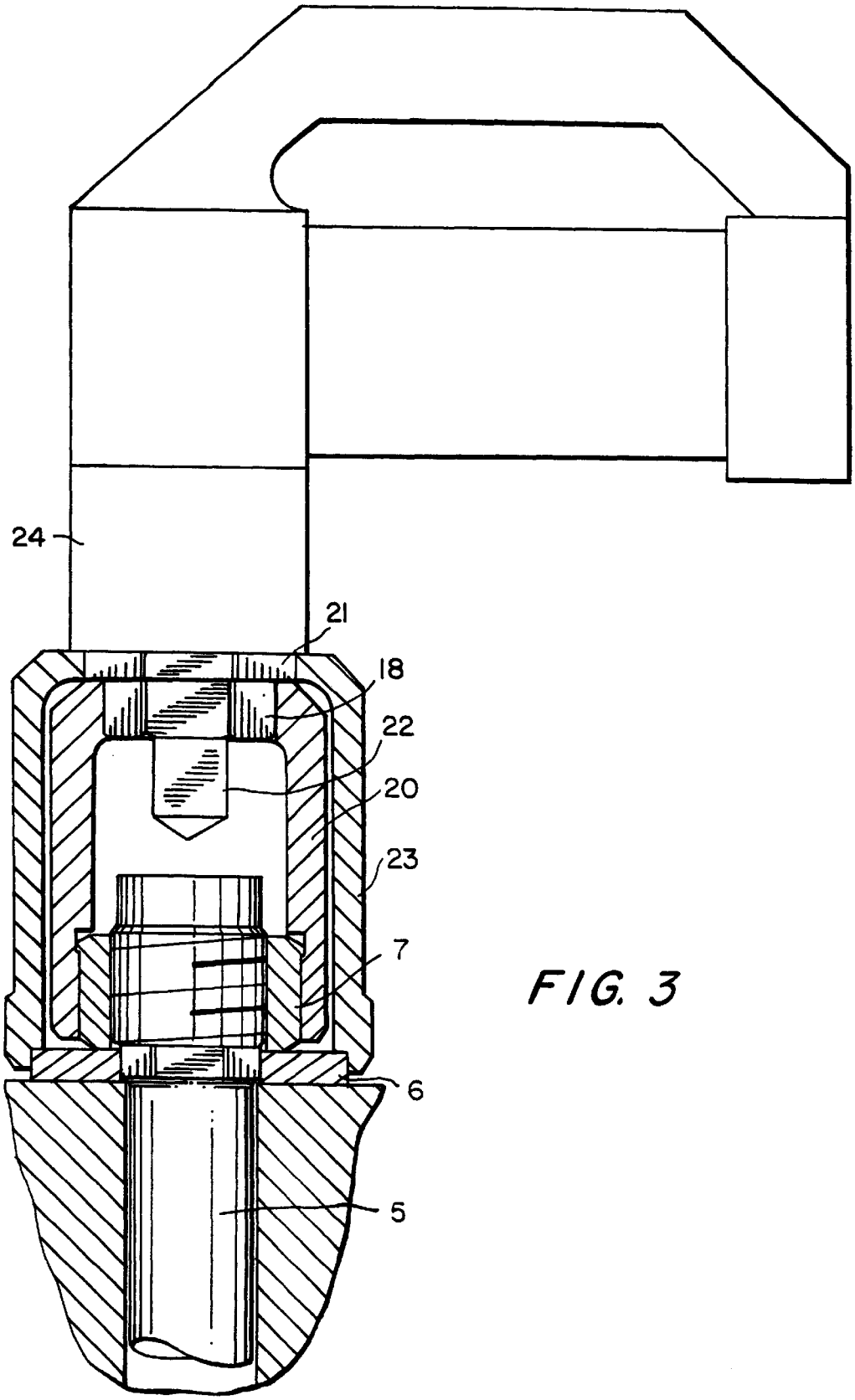
FIGS. 3 and 4 are views showing a rotary motor-type power tool for tightening and loosening a bolt provided with a washer and a nut, with application of a reaction force to the washer in FIG. 3 and to the bolt in FIG. 4.
Figure 4:
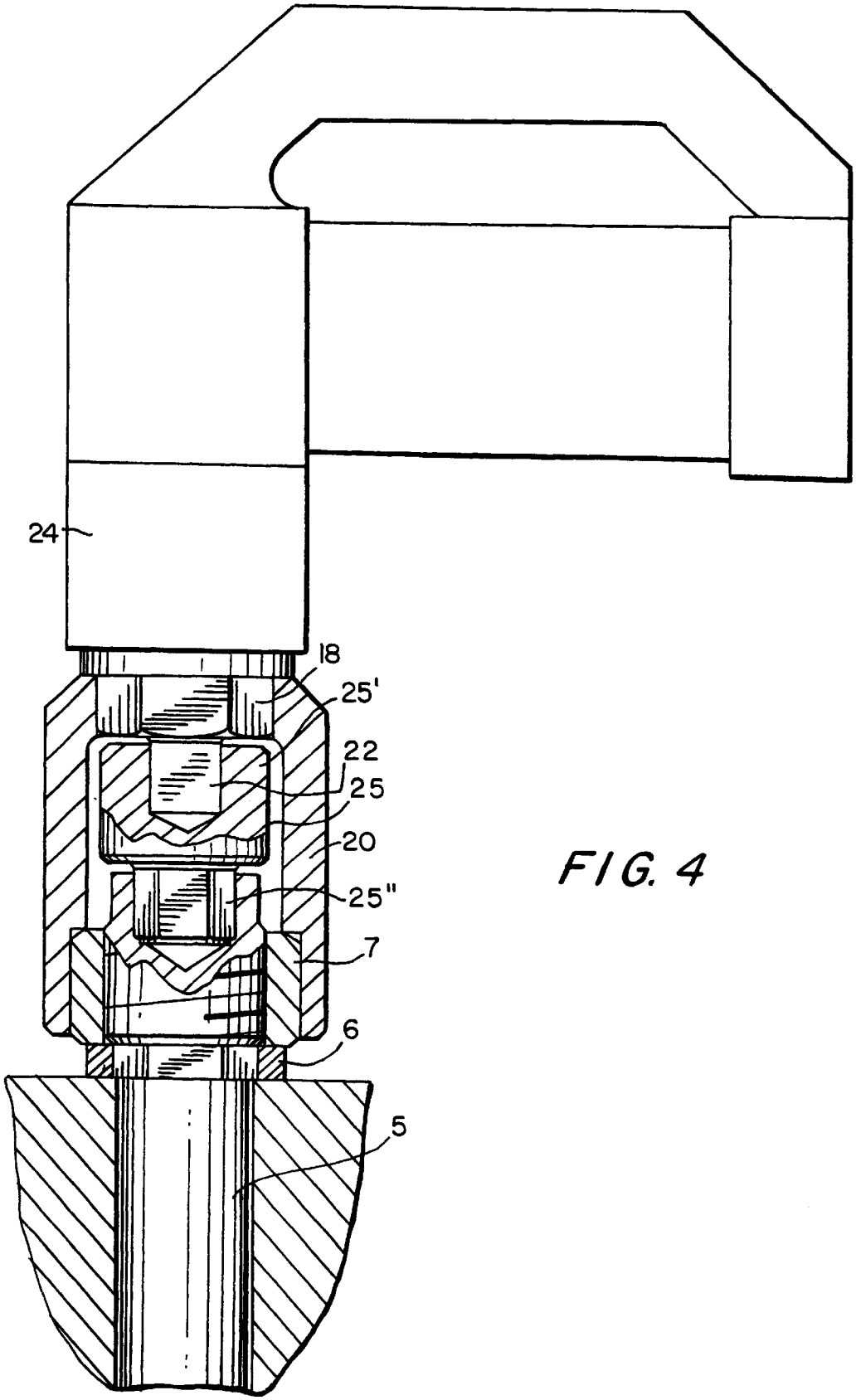

FIGS. 3 and 4 show a rotary motor-type power tool with a housing 24 which has at least a part arranged coaxially with a drive axis. The tool is used also for tightening or loosening a bolt 5 having a washer 6 with an inner polygonal opening and an outer polygonal surface, and a standard hexagonal nut 7 with an inner thread and an outer polygonal surface.

The power tool is provided with first connecting means for connecting a not shown drive unit with the nut 7. The first connecting means is identified with reference numeral 18 and formed as a polygonal projection connected with a turnable shaft or the like of the not shown drive unit. A first transferring member 20 which is formed as a drive socket has one portion provided with an inner polygonal opening engaging with the polygonal projection 18, and another portion provided with an inner hexagonal opening engaging with the hexagonal outer surface of the nut 7.

The tool further has second connecting means for non-rotatably connecting the housing 24 with the washer 6. The second connecting means include one selectively actuatable means which is formed for example as a polygonal projection 21 of the housing 24. transmitting member non-rotatably connects the selectively actuatable means with the washer 6. It is formed as a reaction socket 23 having one portion provided with an inner polygonal opening for engaging the polygonal projection 21 of the housing, and another portion provided with a polygonal opening for engaging an outer polygonal surface of the washer 6, as shown in FIG. 3.

The second connecting means of the power tool shown in FIGS. 3 and 4 also has another selectively actuatable means 22 which is formed for example as a non-rotatable square projection connected to a non-rotatable part of the housing or the drive. A transmitting member 25 non-rotatably connects the selectively actuatable means 22 with the bolt 5. The transmitting member 25 has one portion 25' which is provided with an inner square opening for receiving the square projection of the selectively actuatable means 22, and another polygonal portion 25' which non-rotatably engages in a polygonal opening at an end of the bolt 5.

The rotary motor-type power tool shown in FIGS. 3 and 4 operates in the following manner. When the drive unit of the tool is activated, it turns the polygonal projection 18 which forms the first connecting means and the drive socket 20, which in turn turns the nut 7. In the situation shown in FIG. 3, the reaction socket 23 non-rotatably connects the selectively actuatable means 21 with the washer 6, which in turn is non-rotatably connected with the bolt 5, so as to provide a reaction force indirectly through the washer 6. As a result, the nut 7 is turned and the bolt 5 is tensioned or relaxed in the parts P1, P2, torsion and side-load free. If it is desirable to react on the bolt directly, the embodiment of FIG. 4 is utilized. Here the drive socket 20 connects the first connecting means 18 with the nut 7, while the shaft 25 connects the selectively actuatable means 22 non-rotatably directly with the bolt 5 to provide a reaction force. As a result, the nut 7 is turned and the bolt is tensioned or relaxed in the parts P1, P2, torsion-and side-load free.

Figure 5:
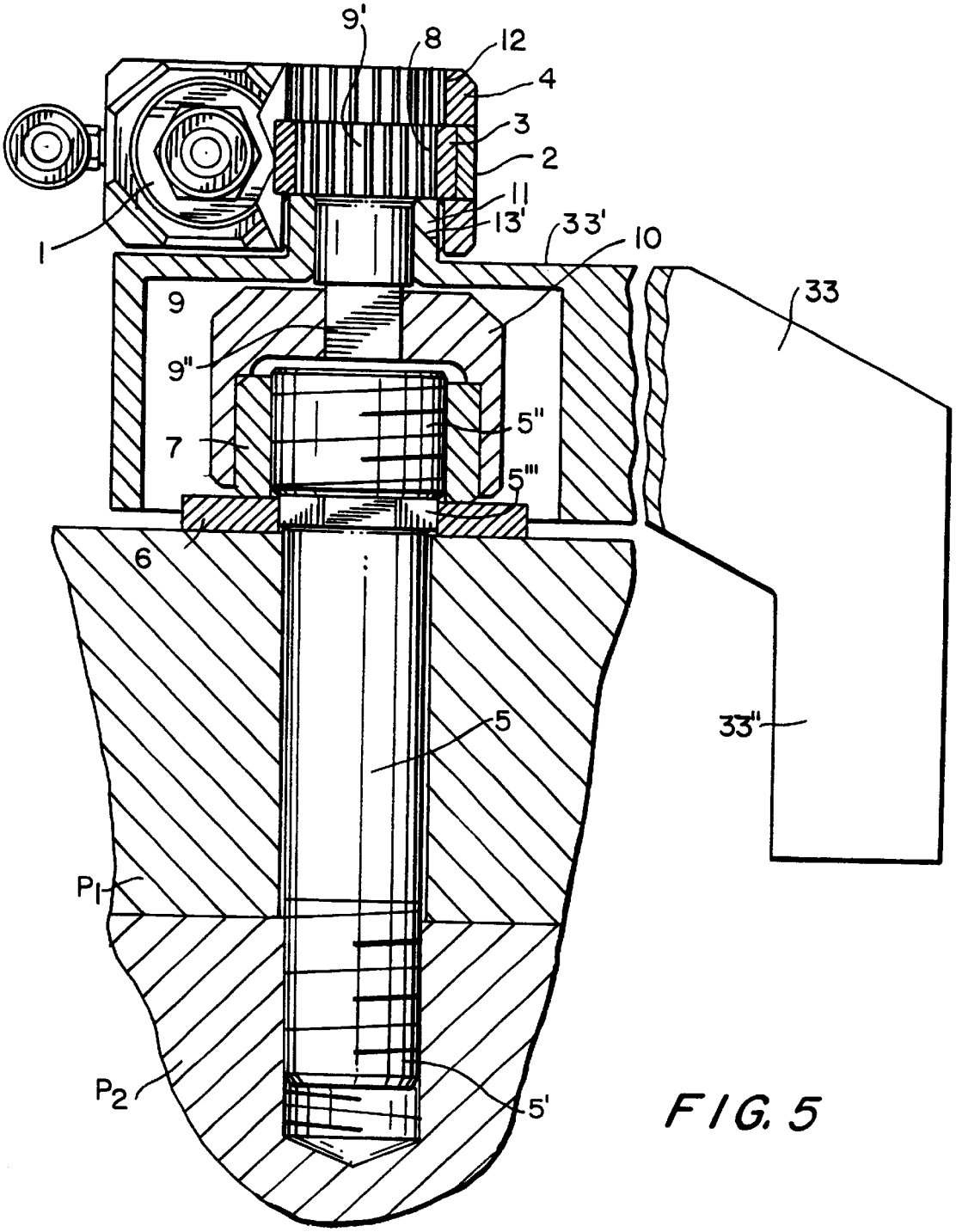
FIG. 5 is a view showing a power tool for tightening and loosening a bolt, which is provided with a reaction arm adapted to abut against an adjacent stationary object to produce a reaction force.

FIG. 5 shows a further embodiment of the tool in accordance with the present invention. The tool here is provided with a reaction arm 33. The reaction arm 33 has one portion 33' which is non-rotatably connectable, for example with the selectively actuatable means 11 of the second connecting means. It further has another portion 33" which is adapted to abut against an adjacent stationary object.

The power tool shown in FIG. 5 operates in the following manner:

The drive unit 1 is activated and turns the drive plate 2, the ratchet 3 is turned by the drive plate 2 and through the first connecting means 8 turns the shaft 9 so that the drive socket 10 is turned, and the nut 7 engaged by the drive socket is turned. The reaction arm 33 abuts against an adjacent stationary object, for example against a neighboring nut or the bolt. As a result, the reaction force is applied to the housing of the tool, while the active force is applied to the nut, the nut is turned and then bolt is tensioned or relaxed in the parts P1 and P2, torsion and side-load free.

It will be understood that each of the elements described above, or two or more together, may also find a useful application in other types of constructions differing from the types described above.

While the invention has been illustrated and described as embodied in a power tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

What is claimed is:

1. A power tool for tightening and loosening a bolt connected with a nut and a washer arranged so that the nut banks with one of its sides onto one of washer faces, the power tool comprising a housing; drive means accommodated in said housing; and at least two coaxial connecting means including a first connecting means provided on said drive means for engaging and turning said nut and subjected to a turning force in one direction, and a second connecting means provided on said housing and subjected to a turning force in an opposite direction, said coaxial connecting means being formed so that one of said coaxial connecting means is being turned while the other of said two coaxial connecting means stand still depending on a turning friction encountered as a result of one being connected with said washer while the other one is connected with said nut, or as a result of one being connected with said bolt and the other one is connected with said nut, or as a result of one being connected with a reaction arm adapted to abut against an adjacent stationary object while the other one is connected with said nut, said second connecting means include two connecting means both provided on said housing axially spaced from one another and connectable either with said washer, or with said bolt, or with the reaction arm.

2. A power tool as defined in claim 1, wherein said drive means and said housing are arranged so as to form together a lever-type power tool with said housing extending perpendicular to a drive axis of said drive means, said two selectively actuatable means of said second connecting means being arranged at opposite sides of said housing as considered in a direction of an axis of said coaxial connecting means.

3. A power tool as defined in claim 1, wherein said drive means and said housing are arranged so as to form a rotary motor-type power tool with said housing arranged coaxially with a drive axis of said drive means, said two selectively actuatable means of said second connecting means being arranged at one side of said housing as considered in a direction of an axis of said coaxial connecting means.

4. A power tool as defined in claim 1, and further comprising transmitting means for transmitting a force from a respective one of said connecting means to a respective one of the bolt, the nut and the washer.

5. A power tool as defined in claim 4, wherein said transmitting means include a first transmitting means for connecting said first connecting means with the nut and formed as a drive socket which turnably connects said drive means through said first transmitting means with the nut, a second transmitting means for non-rotatably connecting one of said selectively actuatable means of said second connecting means with the washer and formed as a reaction socket which holds the washer non-rotatably relative to said housing, and a third transmitting means for non-rotatably connecting another of said selectively actuatable means of said second connecting means with the bolt and formed as a projection which holds the bolt non-rotatably relative to said housing.

6. A power tool as defined in claim 1, wherein at least one of said selectively actuatable means of said second connecting means is connectable with the reaction arm adapted to abut against an adjacent stationary object.

7. A power tool for tightening and loosening a bolt connected with a nut and a washer arranged so that the nut banks with one of its sides onto one of washer faces, the power tool comprising a housing; drive means accommodated in said housing; and at least two coaxial connecting means including a first connecting means provided on said drive means for engaging and turning said nut and subjected to a turning force in one direction, and a second connecting means provided on said housing and subjected to a turning force in an opposite direction, said coaxial connecting means being formed so that one of said coaxial connecting means is being turned while the other of said two coaxial connecting means stand still depending on a turning friction encountered as a result of one being connected with said washer while the other one is connected with said nut, or the result of one being connected with said bolt and the other one is connected with said nut, or as a result of one being connected with a reaction arm adapted to abut against an adjacent stationary object while the other one is connected with said nut, said connecting means include two connecting means both connectable axially spaced from one another, arranged at opposite sides of said housing as considered in a direction of an axis of said coaxial connecting means and connectable either with said washer, or with said bolt, or with said reaction arm.

* * * * *